US007612647B2

(12) United States Patent
Onoda et al.

(10) Patent No.: US 7,612,647 B2
(45) Date of Patent: Nov. 3, 2009

(54) FUSIBLE LINK

(75) Inventors: Shinya Onoda, Shizuoka (JP); Toshiharu Kudo, Shizuoka (JP); Yoshihiko Nakahama, Aichi (JP); Takanori Kawai, Aichi (JP)

(73) Assignee: Yazaki Corporation, Tokyo (JP)

( * ) Notice: Subject to any disclaimer, the term of this patent is extended or adjusted under 35 U.S.C. 154(b) by 83 days.

(21) Appl. No.: 11/521,340

(22) Filed: Sep. 15, 2006

(65) Prior Publication Data

US 2007/0063809 A1 Mar. 22, 2007

(30) Foreign Application Priority Data

Sep. 21, 2005 (JP) ..... 2005-273290

(51) Int. Cl.
*H01H 85/143* (2006.01)
*H01H 85/165* (2006.01)

(52) U.S. Cl. ..... 337/229; 337/159; 337/161; 337/186; 337/187; 337/227

(58) Field of Classification Search ..... 337/229, 337/159, 161, 227, 186, 187
See application file for complete search history.

(56) References Cited

U.S. PATENT DOCUMENTS 5,088,940 A * 2/1992 Saito ..... 439/620.34
5,438,310 A * 8/1995 Ikari ..... 337/208
5,474,475 A * 12/1995 Yamaguchi ..... 439/620.27
5,643,693 A * 7/1997 Hill et al. ..... 429/121
5,795,193 A * 8/1998 Yang ..... 439/620.27
5,886,611 A * 3/1999 Schaller et al. ..... 337/189
6,007,350 A * 12/1999 Isshiki ..... 439/76.2
6,178,106 B1 * 1/2001 Umemoto et al. ..... 363/146
6,322,376 B1 * 11/2001 Jetton ..... 439/76.2
6,509,824 B2 * 1/2003 Inaba et al. ..... 337/295
6,558,198 B2 * 5/2003 Kobayashi et al. ..... 439/620.29
6,759,938 B2 * 7/2004 Matsumura et al. ..... 337/161
6,824,430 B2 * 11/2004 Matsumura et al. .... 439/620.29
6,830,482 B2 * 12/2004 Matsumura et al. .... 439/620.27
7,071,808 B2 * 7/2006 Nakamura ..... 337/256
2005/0285709 A1 * 12/2005 Matsumura et al. ..... 337/227

FOREIGN PATENT DOCUMENTS

JP 05258813 A * 10/1993
JP 2004-127698 4/2004

* cited by examiner

*Primary Examiner*—Anatoly Vortman
(74) *Attorney, Agent, or Firm*—Kratz, Quintos & Hanson, LLP

(57) ABSTRACT

A plurality of fuse circuits are layered with a space therebetween in a housing. A fusible portion of one of the layered fuse circuits is offset from a fusible portion of an adjacent one of the layered fuse circuits perpendicularly to a direction in which the fuse circuits are layered. A connection plate of one of the layered fuse circuits is offset from a connection plate of an adjacent one of the layered fuse circuits perpendicularly to a direction in which the fuse circuits are layered. The connection plate has a U-shaped extended portion.

3 Claims, 6 Drawing Sheets

FUSIBLE LINK

BACKGROUND OF THE INVENTION

1. Field of the Invention

The present invention relates to a fusible link used for electrical circuits of an automotive vehicle or the like.

2. Background Art

An automotive vehicle is arranged with various types of electrical equipment. In electrical circuits to supply electrical power from a battery to the electrical equipment, a fusible link is mounted to serve as a fuse device to protect the circuits from an overcurrent. Such an art is disclosed, for example, in Japanese Patent Application Laid-open No. 2004-127698.

The fusible link has a connection plate, a fusible portion continuous with one side of the connection plate, and a terminal continuous with the fusible portion. The fusible portion and the terminal constitute a fuse element. The fuse element is continuous with the connection plate to define a fuse circuit. The fuse circuit is received in a housing.

In the housing, a plurality of the fuse circuits are layered with a space therebetween. Each fuse circuit is electrically connected to each of a plurality of electrical instruments or machines. Thereby, the single fusible link can manage collectively the electrical instruments or machines.

The fusible link is received in a fuse box or in a junction box accommodating various electrical circuit units within a vehicle body. This provides fuses in electrical circuits from a battery to the electrical instruments or machines.

The housing of the fusible link has a window to see the inside of the housing. Through the window, the state of fusible portions of the fuse circuits can be are checked. When a fusible portion is fused by an overcurrent running in one of the electric circuits, the fusible link is replaced by a new one to enable conduction of the circuit.

The fusible link can be is easily replaced when the fusing portion is fused so that the fusible link is utilized as a large current fuse in various fields or machines including automotive vehicles.

The fusible link is disposed at a position where the electrical circuits are concentrated. Therefore, it is desirable that the fusible link itself is compact. Thus, the fuse circuits are layered with a smaller space therebetween in the housing so that the housing has a smaller depth.

However, the smaller space between the fuse circuits causes the fusible portions of the fuse circuits to come close to each other. Thus, when the fusible portion of one of the fusible portions is heated by an overcurrent, an adjacent fusible portion is also effected by the heat so that the adjacent fusible portion will have a less fusing time.

Therefore, a larger space between the fuse circuits is preferable to have a smaller effect on the adjacent fusible portion when the one of the fusible portions is heated by an overcurrent. However, this can not achieve a compact fusing link, requiring a larger depth housing.

SUMMARY OF THE INVENTION

Hence, an object of the invention is to provide a fusing link having a compact design. The fusing link has a fuse circuit with a fusible portion that operates stably to provide an appropriate fusing time.

For achieving the object, a fusible link according to the present invention includes:

a connection plate, a fusible portion continuous with one side of the connection plate, a terminal continuous with the fusible portion, at least one fuse element having the fusible portion and the terminal, a fuse circuit having the connection plate continuous with the fuse element, and a housing accommodating the fuse circuit, wherein a plurality of the fuse circuits are layered with a space therebetween in the housing, the fusible portion of one of the layered fuse circuits being offset from the fusible portion of an adjacent one of the layered fuse circuits perpendicularly to a direction in which the fuse circuits are layered.

Thus, even when the housing is horizontally placed, the heat generated by a fusible portion of a lower one of the fuse circuits has a less effect on a fusible portion of an upper one of fuse circuits. This prevents the fusible portion of the upper one of fuse circuits from reducing its fusing time, ensuring reliable operation of the fusing portion. Therefore, the fusing link is compact and the fusible portions of the fuse circuits have a reliable fusing time and a stable performance.

Furthermore, since the fusible portion of one of the layered fuse circuits is offset or deviated from the fusible portion of an adjacent one of the layered fuse circuits perpendicularly to a direction in which the fuse circuits are layered, it is easy to check and maintain the fusing link. Because, an inspector can see the fusible portions of the upper and lower fuse circuits simultaneously downwardly.

Preferably, the connection plate of one of the layered fuse circuits is offset from the connection plate of an adjacent one of the layered fuse circuits perpendicularly to a direction in which the fuse circuits are layered.

Thus, the heat conducted to the connection plate of a lower one of the fuse circuits by an overcurrent given to an associated fusible portion has a less effect on the connection plate of an upper one of the fuse circuits. This prevents the fusible portion of the upper one of fuse circuit from reducing its fusing time, ensuring reliable operation of the fusing portion. Therefore, the fusing link is compact and the fusible portion of the fuse circuit has a reliable fusing time and a stable performance.

Preferably, the connection plate has a U-shaped extended portion. Thus, the connection plate can have a larger area to increase a heat radiation ability with a compact design of the fusible link, preventing a temperature increase of the whole fuse circuits.

BRIEF DESCRIPTION OF THE ACCOMPANIED DRAWINGS

DETAILED DESCRIPTION OF PREFERRED EMBODIMENTS

Figure 1:
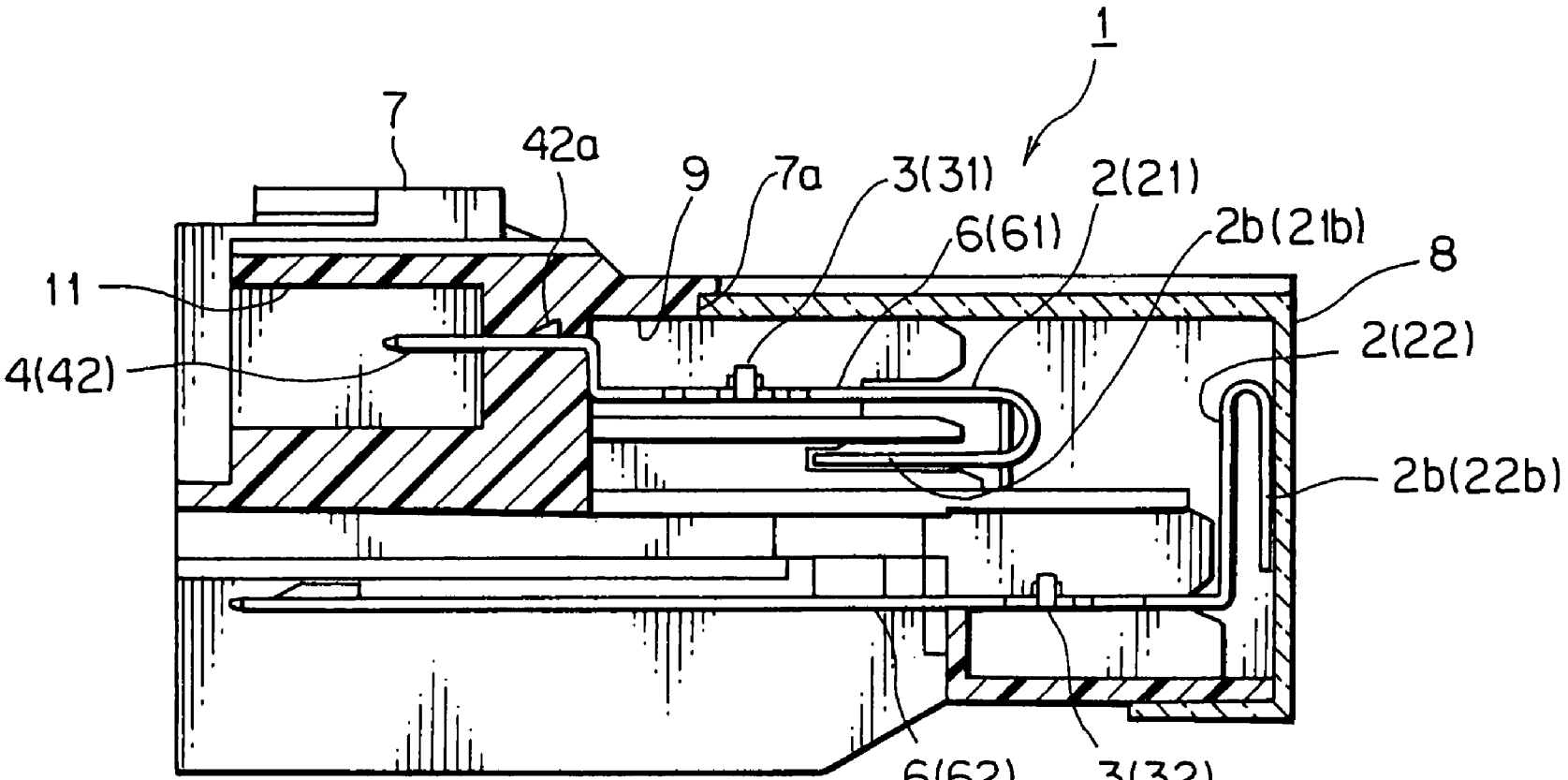
FIG. 1 is a sectional side view showing a fusible link of an embodiment according to the present invention.

Referring to FIGS. 1 to 4, a fusible link of an embodiment according to the present invention will be discussed.

A fusible link 1 according to the present invention has a connection plate 2, a fusible portion 3 continuous with one side of the connection plate 2, and a terminal 4 continuous with the fusible portion 3. The fusible portion 3 and the terminal 4 constitute a fuse element 5. The fuse element 5 is continuous with the connection plate 2 to define a fuse circuit 6. The fuse circuit 6 is received in a housing 7.

Figure 3:
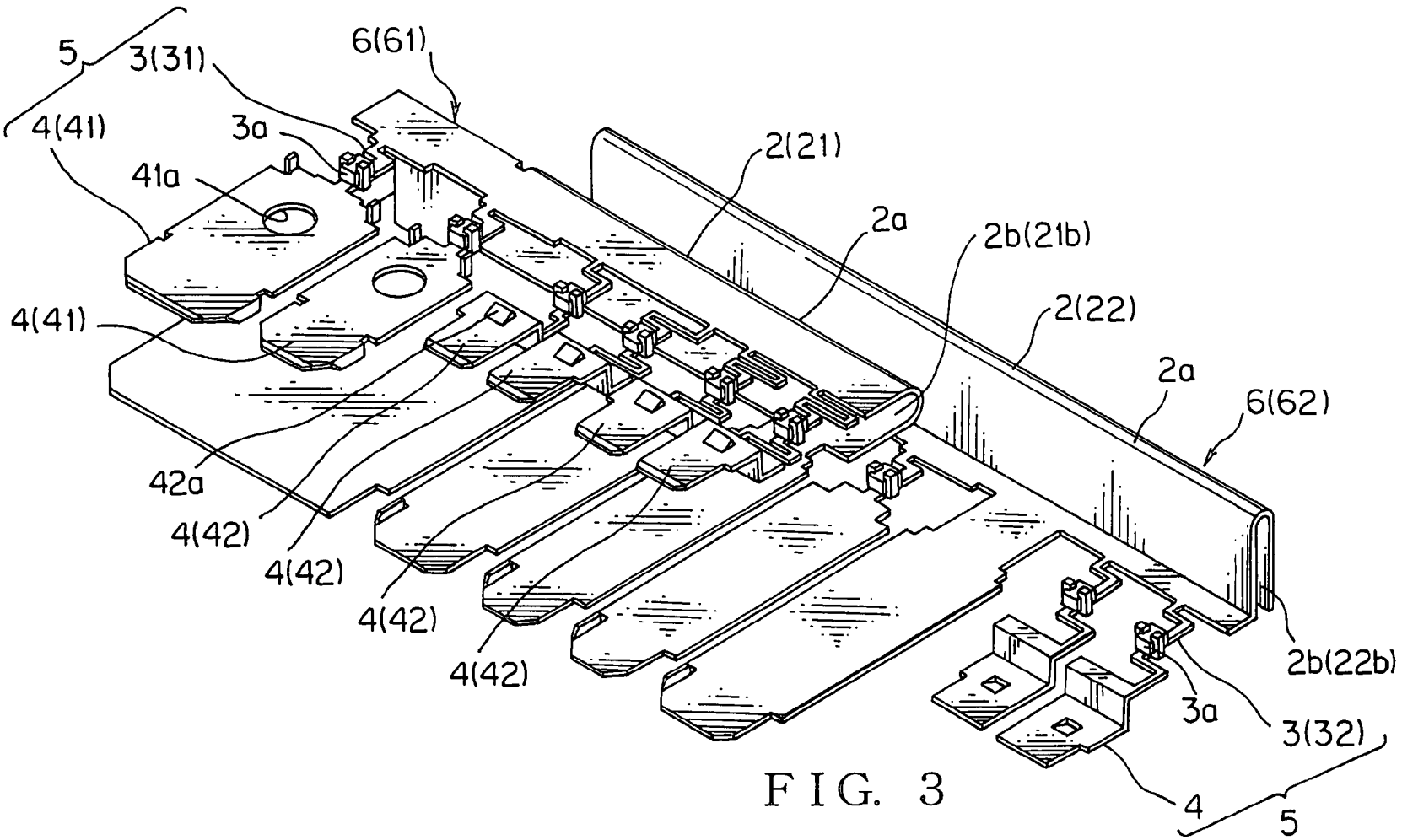
FIG. 3 is a perspective view showing a fuse circuit of the fusible link of the embodiment.

As shown in FIG. 3, the connection plate 2 is a common terminal of the fuse circuit 6 and serves as a busbar plate used for a ground circuit.

The fusible portion 3 continuous with one side of the connection plate 2 has a crank-shape with a small width. In a middle of the crank-shaped fusible portion 3, a low fusing point metal 3*a* is clamped and secured thereto. When an electrical current larger than a predetermined value runs in the fusible portion 3, the fusible portion 3 with the low fusing point metal 3*a* is fused by heat generated by the larger current.

The fusible portion 3 and the terminal 4 continuous with the fusible portion 3 constitute the fuse element 5. The fusible portion 3 is continuous with the connection plate 2 to define the fuse circuit 6. In the embodiment, as shown in FIG. 3, a plurality of the fuse elements 5 are continuous with one side of the connection plate 2 parallel to each other to define the fuse circuit 6.

Each fuse element 5 has a terminal 41 fitted with a bolt (not shown) or a terminal 42 that defines an insertion terminal. The bolt-fitted terminal 41 has a bolt hole 41*a* receiving the securing bolt. The insertion terminal 42 has a locking piece 42*a* engaging with the housing 7.

The fuse circuit 6 is defined by press-forming an electrically conductive plate (not shown). From the single conductive plate, the connection plate 2, the fusible portions 3, and the terminals 4 are defined as a one piece.

As shown in FIG. 3, the connection plate 2 of the fuse circuit 6 has a U-shaped portion 2*b* in a side 2*a* opposite to the fuse elements 5.

Figure 2:
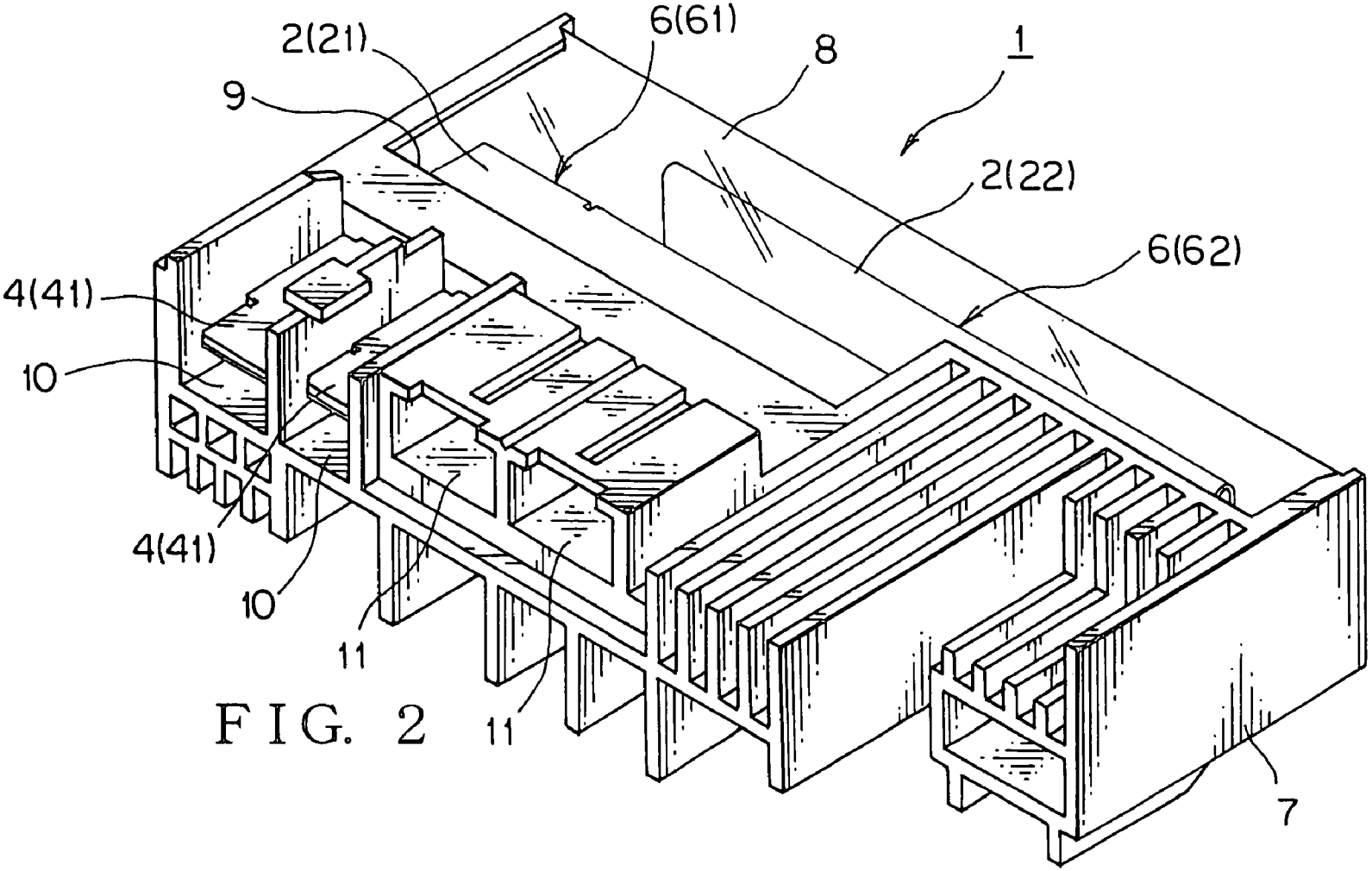
FIG. 2 is a perspective view showing the fusible link of the embodiment.

The housing 7, as shown in FIGS. 1 and 2, is generally a rectangular box made of an insulating resin. The housing 7 has an opening 7*a* extended from an upper portion to a side portion generally in a longitudinal direction of the housing 7 for inserting the fuse circuits 6.

The opening 7*a* is covered by a transparent cover 8. Even when the transparent cover 8 has covered the opening 7*a*, an inspector can see the inside of the housing from the outside.

In the housing 7, a circuit accommodation chamber 9 is defined to be continuous with the opening 7*a*. In a side of the circuit accommodation chamber 9, a terminal receiving recess 10 and a connector housing 11 are defined to be contiguous with the circuit accommodation chamber 9. The terminal receiving recesses 10 and the connector housings 11, as shown in FIG. 2, are positioned side-by-side in an opposite side of the housing 7 along a longitudinal direction of the housing.

In the housing 7, as shown in FIG. 1, two of the fuse circuits 6 are inserted from the opening 7*a* in a lateral direction of the housing such that the terminals 4 advance ahead. Thereby, the inserted fuse circuits 61, 62 are layered within the circuit accommodation chamber 9 in the depth direction of the housing 7.

The fusible link 1, as shown in FIG. 1, is mounted in a vehicle such that a lateral direction of the housing 7 becomes horizontal. That is, the fusible link is a horizontally positioned one. Thus, the fuse circuits 61, 62 received in the housing 7 direct horizontally in a lateral direction of the housing 7.

Note that the fuse circuits 61, 62, as shown in FIG. 1, are layered in the circuit accommodation chamber 9 with a small space therebetween so that the fuse circuits 61, 62 are arranged close to each other.

The upper fuse circuit 61 has the fusible portion 31 that is offset from the fusible portion 32 of the lower fuse circuit 62 perpendicularly to the layering direction of the fuse circuits 61, 62 (in a direction parallel to the insertion direction of the fuse circuit 61 or 62).

The fuse circuits 61, 62 are horizontally directed and layered vertically. The fuse circuits 61, 62 are disposed laterally such that the fuse circuits 61, 62 are offset perpendicularly to the layering direction of the fuse circuits 61, 62 relative to the fusible portion 31 of the upper fuse circuit 61. Thus, the fusible portion 32 of the lower fuse circuit 62 is not positioned just under the fusible portion 31 of the upper fuse circuit 61.

Figure 4:
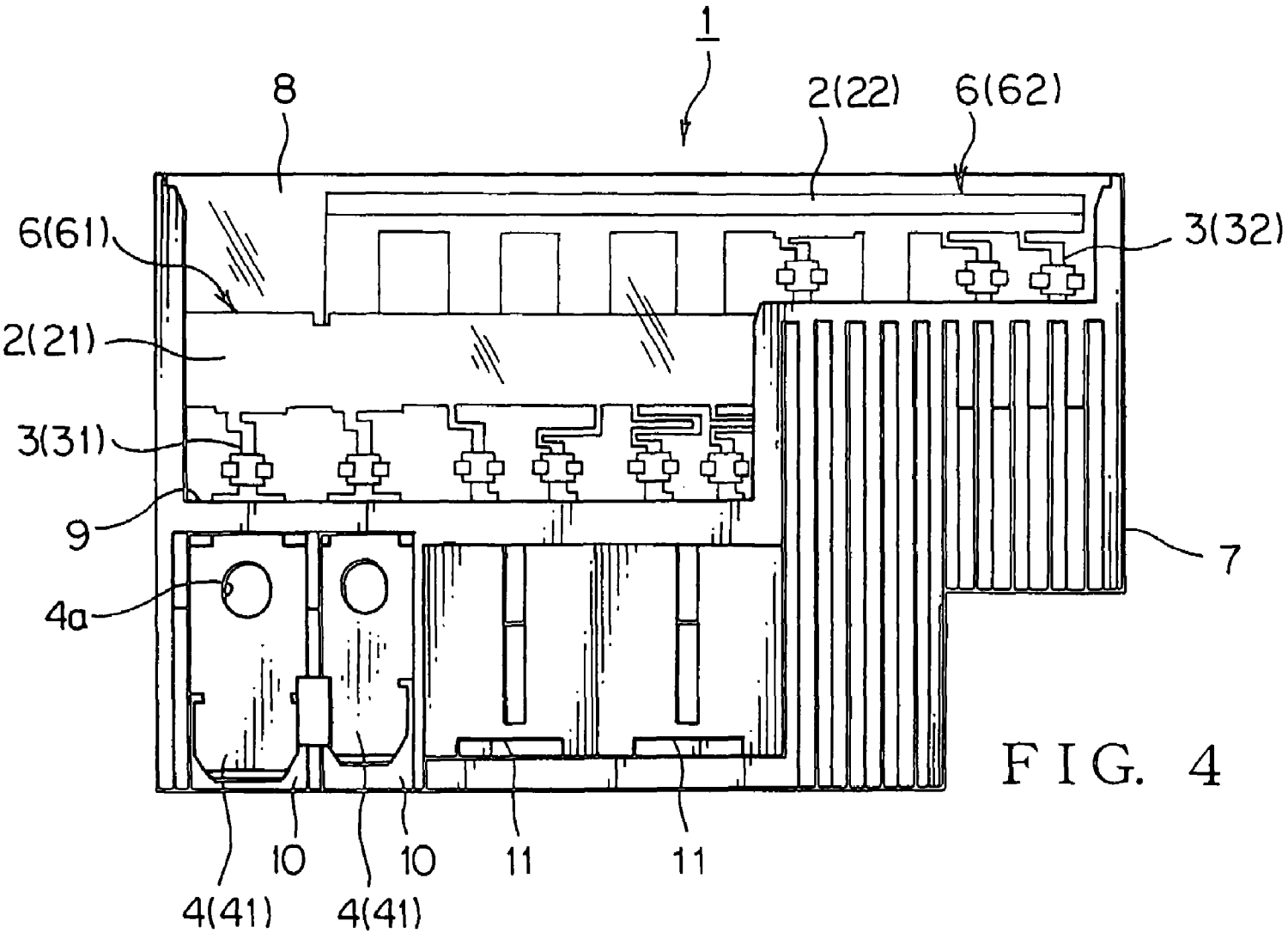
FIG. 4 is a plan view showing the fusible link of the embodiment.

Thus, when an inspector checks the fuse circuits 6 received in the housing 7 through the transparent cover 8 from the outside, as shown in FIG. 4, he can see both the fusible portions 31 of the upper fuse circuit 61 and the fusible portions 32 of the lower fuse circuits 62.

Furthermore, as shown in FIG. 1, the connection plate 21 of the upper fuse circuit 61 is offset from the connection plate 22 of the lower fuse circuit 62 perpendicularly to the layering direction of the fuse circuits 61, 62.

The upper fuse circuit 61 has the connection plate 21 formed with a U-shaped portion 21*b*, and the U-shaped portion 21*b* is positioned to direct horizontally. Meanwhile, the lower fuse circuit 62 has the connection plate 22 formed with a U-shaped portion 22*b*, and the U-shaped portion 22*b* is bent from the lower fuse circuit 62 to rise vertically as shown in FIG. 1. Thus, the upper fuse circuit 61 doses not interfere with the lower fuse circuit 62 vertically.

In the fusible link 1, as discussed above, the fuse circuit 6 is inserted into the housing 7 from the opening 7*a* in the lateral direction of the housing with the terminal 4 being carried ahead. The inserted fuse circuit 6 is received in the circuit accommodation chamber 9, and the terminal 4 is positioned in the terminal receiving recess 10 of the housing 7 and in the connector housing 11 through the circuit accommodation chamber 9.

The terminal 4 (41) of the fuse circuit 6 disposed in the terminal receiving recess 10 of the housing 7 is connected to a round terminal fitting (not shown) of an electrical cable. A securing bolt (not shown) is inserted into the round terminal fitting and the bolt fitted terminal 41 is secured in the terminal receiving recess 10 of the housing 7. Thereby, the cable is electrically connected to the fuse circuit 6.

The terminal 4 (42) of the fuse circuit 6, which is an insertion terminal 42 disposed in the connector housing 11 of the housing 7, is connected to a connector (not shown), so that the connector is electrically connected to the fuse circuit 6. The insertion terminal 42 has a locking protrusion.

The cable or the connector is electrically connected to one of various electrical instruments and machines (not shown). The fuse circuit 6 connected to the cable or the connector electrically connects the fusible link 1 to each of the instruments and machines. Accordingly, the single fusible link 1 can manages collectively the plurality of electrical instruments and machines.

In the fusible link 1, when an overcurrent runs from a battery to an electrical circuit for an electrical appliance, a fusible portion 3 of the fusible link 1 is fused by the generated heat, protecting the electrical circuit from the overcurrent.

Since the housing 7 is mounted on the vehicle such that the lateral direction of the housing 7 is horizontal, an inspector can see downwardly the condition of the fusible portion 3 of the fuse circuit 6 in the housing 7 through the transparent cover 8 for maintenance of the fusible link 1.

In the fusible link 1, for example, when an overcurrent runs into an electrical appliance connected to a lower fuse circuit 62 positioned in a lower side of the circuit accommodation chamber 9, the fusible portion 32 of the lower fuse circuit 62 is heated. A predetermined duration of the heated condition fuses the fusible portion 32.

The heat generated in the lower fuse circuit 62 conducts upward in the circuit accommodation chamber 9 but has little possibility that the heat of the fusible portion 32 directly conducts to the upper fusible portion 31. Because, the fusible portion 31 of the upper fuse circuit 61 is offset from the fusible portion 32 of the lower fuse circuit 62 adjacent to the upper fuse circuit 61 perpendicularly to the layering direction of the fuse circuits 61, 62 relative to the fusible portion 31 of the upper fuse circuit 61.

Thus, even when the fuse circuits 61, 62 are layered in the circuit accommodation chamber 9 with a little space therebetween so that the fuse circuits 61, 62 are positioned close to each other, the heat generated by a fusible portion 32 of the lower fuse circuit 62 has a less effect on a fusible portion 31 of the upper fuse circuit 61. This prevents the fusible portion 31 of the upper fuse circuit 61 from reducing its fusing time, ensuring reliable operation of the fusible portion 31. Therefore, the fusing link is compact and the fusible portion 31 of the fuse circuit upper fuse circuit 61 has a reliable fusing time and a stable performance.

Furthermore, since the fusible portion 31 of the upper fuse circuit 61 is offset from the fusible portion 32 of the lower fuse circuit 62 adjacent to the upper fuse circuit 61 perpendicularly to a direction in which the fuse circuits 6 are layered, it is easy to check and maintain the fusing link 1. Because, an inspector can see the fusible portions 31, 32 of the upper and lower fuse circuits 61, 62 in the housing 7 simultaneously downward through the transparent cover 8. This achieves an easy inspection and maintenance work of the fusible link 1.

As described above, the connection plate 21 of the upper fuse circuit 61 is offset from the connection plate 22 of the lower fuse circuit 62 perpendicularly to the layering direction of the fuse circuits 61, 62. Thus, the upper connection plate 21 is offset vertically from the lower connection plate 22, so that the heat generated in the lower connection plate 22 in addition to the heat of the lower fusible portion 32 has a less effect on the upper connection plate 21.

Therefore, the heat generated in the connection plate 22 of the lower fuse circuit 62 has a less effect on the connection plate 21 of the upper fuse circuit 61. This prevents the fusible portion 31 of the upper fuse circuit 61 from reducing its fusing time, ensuring reliable operation of the fusible portion 31. Hence, the fusible link 1 is compact and the fusible portion 31 of the upper fuse circuit 61 has a reliable fusing time and a stable performance.

As described above, the connection plate 2 has a U-shaped extended portion 2*b*. Thus, the connection plate 2 can have a larger area to increase a heat radiation ability with a compact design of the fusible link 1, decreasing a temperature increase of the whole fuse circuits.

In the embodiment, the fusible portion 31 of the upper fuse circuit 61 is offset from the fusible portion 32 of the lower fuse circuit 62 adjacent to the upper fuse circuit 61 perpendicularly to a direction in which the fuse circuits 61, 62 are layered. Thus, even when the housing 7 is horizontally placed, the heat generated by the fusible portion 32 of the lower fuse circuit 62 has a less effect on the fusible portion 31 of the upper fuse circuit 61. This prevents the fusible portion 32 of the upper fuse circuit 61 from reducing its fusing time, ensuring reliable operation of the fusible portion 31. Therefore, the fusible link 1 is compact and the fusible portion 31 of the upper fuse circuit 61 has a reliable fusing time and a stable performance.

Furthermore, since the fusible portions 31, 32 of the layered fuse circuits 61, 62 are offset from each other perpendicularly to a direction in which the fuse circuits 61, 62 are layered, it is easy to check and maintain the fusible link 1. Because, an inspector can see the fusible portions 31, 32 of the upper and lower fuse circuits 61, 62 in the housing 7 simultaneously downward.

Furthermore, the connection plate 21 of the upper fuse circuit 61 is offset from the connection plate 22 of the lower fuse circuit 62 perpendicularly to a direction in which the fuse circuits 61, 62 are layered. Thus, the heat conducted to connection plate 22 of the lower fuse circuit 62 has a less effect on the connection plate 21 of the upper fuse circuit 61. This prevents the fusible portion 31 of the upper fuse circuit 61 from reducing its fusing time, ensuring reliable operation of the fusible portion 31. Therefore, the fusible link is compact and the fusible portion 31 of the upper fuse circuit 61 has a reliable fusing time and a stable performance.

Furthermore, the connection plate 2 has a U-shaped extended portion 2*b*. Thus, the connection plate 2 can have a larger area to increase a heat radiation ability with a compact design of the fusible link 1, decreasing a temperature increase of the whole fuse circuits 6.

The embodiment discussed above is one aspect of the present invention, and the present invention is not limited in the embodiment but can be modified variously within the spirit of the present invention.

Figure 5:
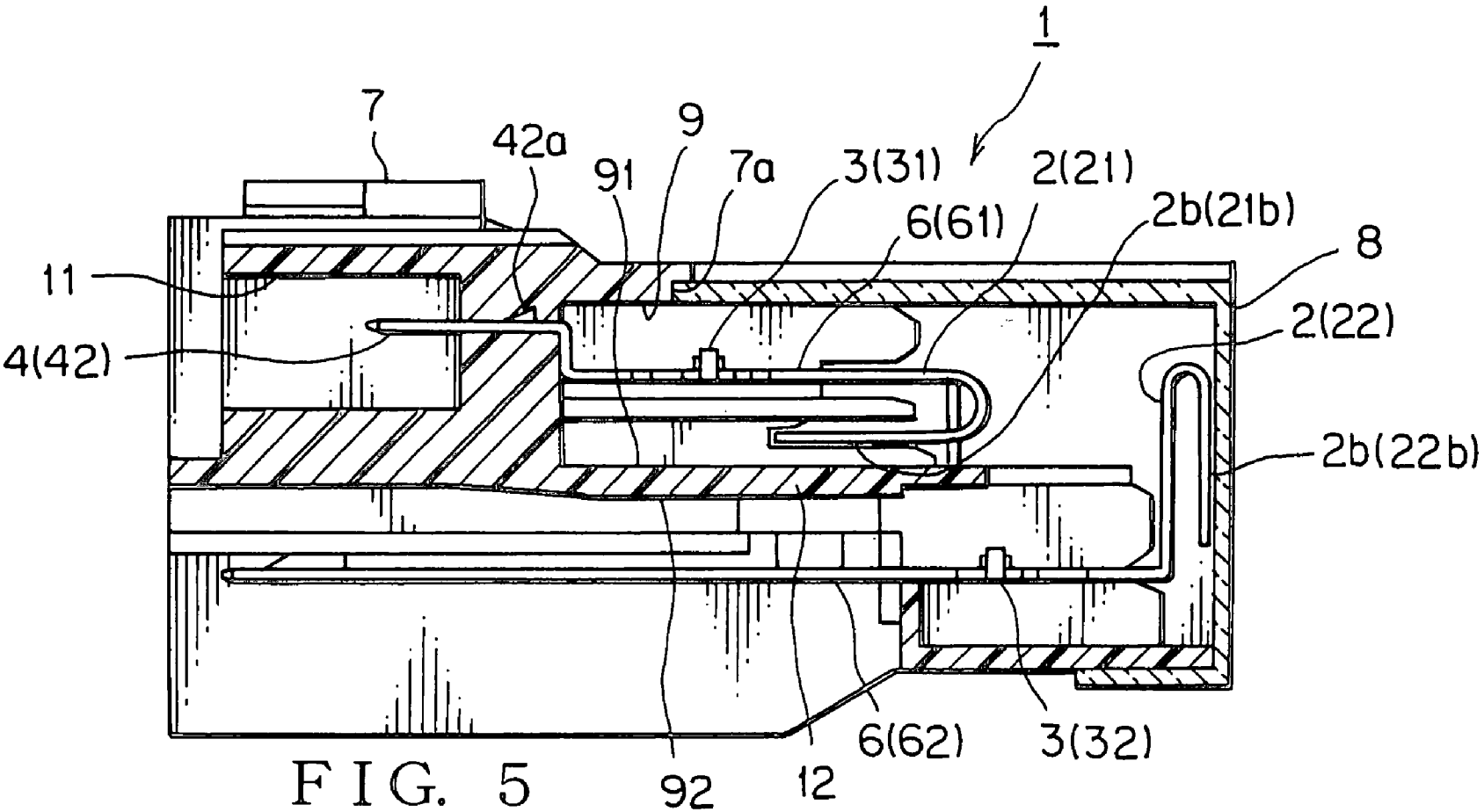
FIG. 5 is a sectional side view showing another fusible link modified from the embodiment.

For example, as shown in FIG. 5, the circuit accommodation chamber 9 defined in the housing 7 has a partition 12 to separate it in upper and lower circuit accommodation chambers 91, 92. The upper circuit accommodation chamber 91 receives the upper fuse circuit 61, while the lower circuit accommodation chamber 92 receives the lower fuse circuit 62. The partition 12 further reduces an effect on the upper fuse circuit 61 of the heat generated by the lower fuse circuit 62.

Figure 6:
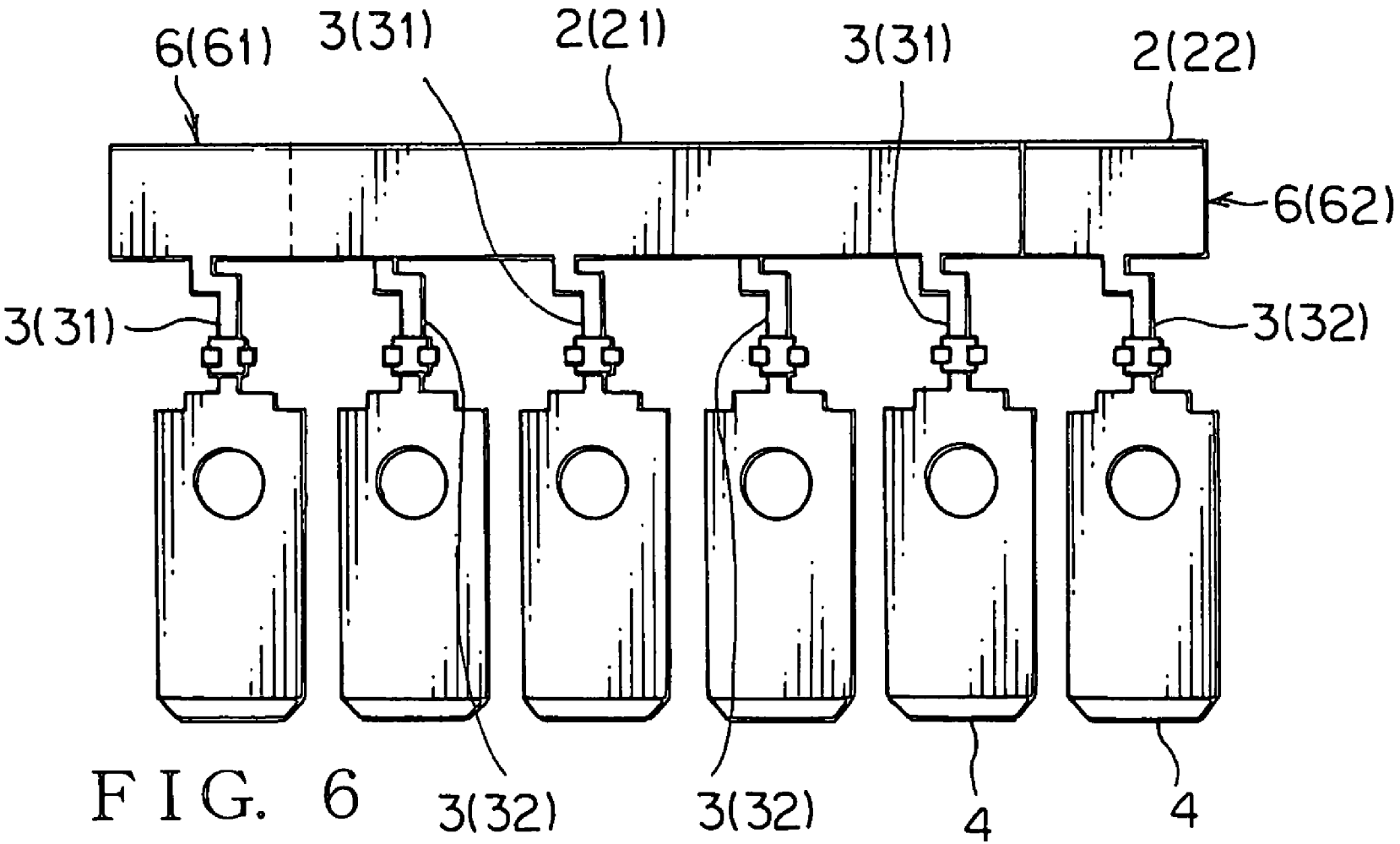
FIG. 6 is a plan view showing a modified fuse circuit of the fusible link of the embodiment.

As shown in FIG. 6, a fusible portion 31 of an upper fuse circuit 61 is offset from a fusible portion 32 of a lower fuse circuit 62 adjacent to the upper fuse circuit 61 perpendicularly to a direction in which the fuse circuits 61, 62 are layered, that is, in a longitudinal direction of connection plates 21, 22. The heat of the lower fusible portion 32 has a less direct effect on the upper fusible portion 31. Therefore, the fusible link 1 is compact and the fusible portion 31 of the upper fuse circuit 61 has a reliable fusing time and a stable performance.

In the discussed embodiment, the fusible link 1 has a plurality of the fuse elements 5 continuous with the connection plate 2 parallel to each other. The connection plate 2 may have only one fuse element 5. Even in this case, a fusible portion of an upper fuse circuit is offset from a fusible portion of a lower fuse circuit perpendicularly to a layered direction of the fuse circuits.

In the discussed embodiment, the housing 7 receives two fuse circuits 61, 62 layered vertically. The housing 7 may receive more than two fuse circuits 6 layered vertically. Even in this case, a fusible portion of an upper fuse circuit is offset from a fusible portion of a lower fuse circuit perpendicularly to a layered direction of the fuse circuits.

What is claimed is:

1. A fusible link (1) comprising:

a connection plate (2), a fusible portion (3) continuous with one side of the connection plate (2), a terminal (4) continuous with the fusible portion (3), at least one ruse element (5) having the fusible portion (3) and the terminal (4), a fuse circuit (6) having the connection plate (2) continuous with the fuse element (5), and a housing (7) accommodating the fuse circuit (6), wherein a plurality of the fuse circuits (6), including upper fuse circuits (61) and lower fuse circuits (62), are layered with a space therebetween in the housing (7), the fusible portion (3) of one of the layered fuse circuits (6) being offset from the fusible portion (3) of an other of the plurality of the fuse circuits (6) which is disposed adjacent the one of the layered fuse circuits (6), said offset being perpendicular to a direction in which the fuse circuits (6) are layered and along a direction directed outwardly from the one side of the connection plate from which the fusible portion (3) is continuous, the fusible portion (3) including upper fusible portions (31) of the upper fuse circuit (61) and lower fusible portions (32) of the lower fuse circuit (62), and wherein both the fusible portions (31) of upper fuse circuits (61) and the fusible portions (32) of lower fuse circuits (62) received in the housing (7) are covered with a transparent cover (8) so as to permit detection of the upper fusible portions (31) and the lower fusible portions (32) from the outside of the housing (7), respectively, and wherein the upper fuse circuit (61) has the connection plate (21) formed with a U-shaped portion (21*b*) positioned horizontally and the lower fuse circuit (6) has the connection plate (22) formed with a U-shaped portion (22*b*) bent from the lower fuse circuit (62) to rise vertically.

2. The fusible link according to claim 1 wherein the connection plate (2) of one of the layered fuse circuits (6) is offset from the connection plate (2) of an adjacent one of the layered fuse circuits (6) perpendicularly to a direction in which the fuse circuits (6) are layered.

3. A fusible link (1) comprising;

a connection plate (2), a fusible portion (3) continuous with one side of the connection piece (2), a terminal (4) continuous with the fusible portion (3), at least one fuse element (5) having the fusible portion (3) and the terminal (4), a fuse circuit (6) having the connection plate (2) continuous with the fuse element (5), and a housing (7) accommodating the fuse circuit (6), wherein a plurality of the fuse circuits (6) are layered with a space therebetween in the housing (7), the fuseible portion (3) of one of the layered fuse circuits (6) being offset from the fusible portion (3) of another of the plurality of the fuse circuits (6) which is disposed adjacent the one of the layered fuse circuits (6), said offset being perpendicular to a direction in which the fuse circuits (6) are layered and along a direction directed outwardly from the one side of the connection plate from which the fusible portion (3) is continuous, and wherein the connection plate (2) is elongated and has a U-shaped cross-section perpendicular to a longitudinal direction of the connection plate (2).

* * * * *